US007327357B2

(12) United States Patent
Jeong

(10) Patent No.: US 7,327,357 B2
(45) Date of Patent: Feb. 5, 2008

(54) PIXEL CIRCUIT AND LIGHT EMITTING DISPLAY COMPRISING THE SAME

(75) Inventor: Jin Tae Jeong, Seoul (KR)

(73) Assignee: Samsung SDI Co., Ltd., Suwon-si (KR)

( * ) Notice: Subject to any disclaimer, the term of this patent is extended or adjusted under 35 U.S.C. 154(b) by 288 days.

(21) Appl. No.: 11/237,631

(22) Filed: Sep. 27, 2005

(65) Prior Publication Data

US 2006/0077194 A1 Apr. 13, 2006

(30) Foreign Application Priority Data

Oct. 8, 2004 (KR) ..... 10-2004-0080621

(51) Int. Cl.
*G09G 5/00* (2006.01)

(52) U.S. Cl. ..... 345/204; 345/90; 345/92; 345/82; 315/169.1; 315/169.3

(58) Field of Classification Search ..... 345/76, 345/78, 82, 90, 92, 204, 210, 211, 214; 315/169.1–169.3
See application file for complete search history.

(56) References Cited

U.S. PATENT DOCUMENTS

| | | | | |
|---|---|---|---|---|
| 6,680,580 | B1 | 1/2004 | Sung | |
| 6,970,149 | B2 * | 11/2005 | Chung et al. | 345/82 |
| 7,109,952 | B2 * | 9/2006 | Kwon | 345/76 |
| 7,180,486 | B2 * | 2/2007 | Jeong | 345/82 |
| 7,184,006 | B2 * | 2/2007 | Kim | 345/76 |
| 7,199,768 | B2 * | 4/2007 | Ono et al. | 345/76 |
| 2003/0227262 | A1 | 12/2003 | Kwon | |
| 2004/0051685 | A1 | 3/2004 | Chung et al. | |
| 2004/0174354 | A1 | 9/2004 | Ono et al. | |
| 2006/0066532 | A1 * | 3/2006 | Jeong | 345/76 |

FOREIGN PATENT DOCUMENTS

| | | |
|---|---|---|
| KR | 10-2004-0008922 | 1/2004 |
| KR | 10-2004-0009285 | 1/2004 |

OTHER PUBLICATIONS

European Search Report, dated Jan. 19, 2006, for application No. EP 05 10 9164.

* cited by examiner

*Primary Examiner*—Haissa Philogene
(74) *Attorney, Agent, or Firm*—Christie, Parker & Hale, LLP

(57) ABSTRACT

A pixel circuit including a light emitting device; a driving transistor to receive first power and supply current corresponding to voltage applied to a gate electrode thereof to the light emitting device; a first switching device to supply a data signal in response to a first scan signal; a second switching device to supply second power to the gate electrode of the driving transistor in response to the first scan signal; a capacitor to store voltage corresponding to the data signal and the second power according to operations of the first and second switching devices; a third switching device to apply voltage corresponding to the voltage stored in the capacitor to the gate electrode of the driving transistor in response to a second scan signal; and a fourth switching device to transmit the first power to the driving transistor in response to a third scan signal.

28 Claims, 9 Drawing Sheets

PIXEL CIRCUIT AND LIGHT EMITTING DISPLAY COMPRISING THE SAME

CROSS-REFERENCE TO RELATED APPLICATIONS

This application claims the priority of Korean Patent Application No. 2004-80621, filed on Oct. 8, 2004, in the Korean Intellectual Property Office, the entire disclosure of which is incorporated herein by reference.

FIELD OF THE INVENTION

The present invention relates to a pixel circuit and a light emitting display comprising the same, and more particularly, to a pixel circuit and a light emitting display comprising the same, in which a threshold voltage is compensated, thereby improving the uniformity of brightness.

BACKGROUND

Recently, various flat panel displays have been developed, to substitute cathode ray tube (CRT) displays because the CRT displays are relatively heavy and bulky. Among the flat panel displays, a light emitting display (LED) is notable because it has high emission efficiency, high brightness, wide view angle, and fast response time.

The light emitting display comprises a plurality of light emitting devices, wherein each light emitting device has a structure in which an emission layer is placed between a cathode electrode and an anode electrode. Here, an electron and a hole are injected into the emission layer and recombined to create an exciton. Light is emitted when the exciton falls to a lower energy level.

Such a light emitting display is classified into an inorganic light emitting display comprising an inorganic emission layer, and an organic light emitting display comprising an organic emission layer.

FIG. 1 is a circuit diagram of a pixel provided in a conventional light emitting display. Referring to FIG. 1, the pixel comprises an organic light emitting device OLED, a driving transistor M2, a capacitor Cst, a switching transistor M1. Further, the pixel is connected to a scan line Sn, a data line Dm, a pixel power line Vdd, and a second power supply line Vss. The second power supply line Vss is a voltage lower that the first voltage supply, for example, a ground voltage. Here, the scan line Sn is arranged in a row direction, and the data line Dm and the pixel power line Vdd are arranged in a column direction. For reference, n is an arbitrary integer between 1 and N, and m is an arbitrary integer between 1 and M.

The switching transistor M1 comprises a source electrode connected to the data line Dm, a drain electrode connected to a first node A, and a gate electrode connected to the scan line Sn.

The driving transistor M2 comprises a source electrode connected to the pixel power line Vdd, a drain electrode connected to the organic light emitting device OLED, and a gate electrode connected to the first node A. Here, the driving transistor M2 supplies current to the organic light emitting device OLED in response to a signal inputted to its gate electrode, thereby allowing the organic light emitting device to emit light. Further, the intensity of the current flowing in the driving transistor M2 is controlled by a data signal transmitted through the data line Dm and switching transistor M1.

The capacitor Cst comprises a first electrode connected to the source electrode of the driving transistor M2, and a second electrode connected to the first node A. Here, the capacitor Cst maintains voltage applied between the source and gate electrodes of the driving transistor M2 in response to the data signal, for a predetermined period.

With this configuration, when the switching transistor M1 is turned on in response to the scan signal transmitted to the gate electrode of the switching transistor M1, the capacitor Cst is charged with a voltage corresponding to the data signal, and then the voltage charged in the capacitor Cst is applied to the gate electrode of the driving transistor M2. Hence, the current flows in the driving transistor M2, thereby allowing the organic light emitting device OLED to emit light.

At this time, the current supplied from the driving transistor M2 to the organic light emitting device OLED is calculated by the following equation.

$$I_{OLED} = \frac{\beta}{2}(Vgs - Vth)^2 = \frac{\beta}{2}(Vdd - Vdata - Vth)^2 \qquad \text{[Equation 1]}$$

where $I_{OLED}$ is a current flowing in the organic light emitting device OLED; Vgs is a voltage applied between the source and gate electrodes of the driving transistor M2; Vth is a threshold voltage of the driving transistor M2, Vdata is a voltage corresponding to the data signal; and β is a gain factor of the driving transistor M2.

Referring to the equation 1, the current $I_{OLED}$ flowing in the organic light emitting device OLED varies depending on the threshold voltage of the driving transistor M2.

However, when the conventional light emitting display is fabricated, deviation arises in the threshold voltage of the driving transistor M2. Thus, the deviation in the threshold voltage of the driving transistor M2 causes in consistencies in the current flowing in the organic light emitting device OLED to be not uniform, thereby deteriorating the uniformity of the brightness of the display device.

Further, the pixel power line Vdd connected to each pixel and supplying pixel power is connected to a first power line (not shown) and supplies the pixel power. In this case, voltage drop arises in the first power supplied from the pixel power line Vdd to the first power line. As the length of the first power line increases, the pixel power line Vdd connected thereto increases in number, thereby causing the voltage drop to get larger.

Particularly, for a large screen of the flat panel display, the voltage drop in the first power line increases further.

SUMMARY OF THE INVENTION

Accordingly, it is an aspect of the present invention to provide a pixel circuit and a light emitting display comprising the same, in which current flows in a driving transistor regardless of a threshold voltage of the driving transistor and pixel power. This way, the variations of the threshold voltage is compensated, so that the amount of current flowing in the light emitting device does not vary with voltage drop in first voltage used for the pixel power and the decrease in the pixel power, thereby improving the uniformity of brightness.

In one embodiment, the present invention is a pixel circuit comprising: a light emitting device; a driving transistor to receive a first voltage and supply a current corresponding to the voltage applied to a gate electrode thereof to the light emitting device; a first switching device to supply a data signal in response to a first scan signal; a second switching device to supply a second voltage to the gate electrode of the driving transistor in response to the first scan signal; a capacitor to store a voltage corresponding to the data signal and the second voltage according to operations of the first and second switching devices; a third switching device to apply voltage corresponding to the voltage stored in the capacitor to the gate electrode of the driving transistor in response to a second scan signal; and a fourth switching device to transmit the first voltage to the driving transistor in response to a third scan signal.

In one embodiment, the present invention is a pixel circuit comprising: a light emitting device; a driving transistor to supply a driving current corresponding to a voltage applied to a gate electrode thereof to the light emitting device; a capacitor to store a predetermined voltage corresponding to a data signal and a second voltage applied to the gate electrode of the driving transistor; a first switch to selectively supply the data signal to the capacitor; a second switch to supply either a voltage stored in the capacitor or the second voltage to the gate electrode of the driving transistor; and a third switch to selectively supply a first voltage to the driving transistor.

In one embodiment, the present invention is a pixel circuit comprising: a light emitting device; a capacitor comprising a first terminal connected to a first node, and a second terminal connected to a third node; a first switching transistor comprising source and drain electrodes connected to a data line and the first node, respetively, and a gate electrode connected to a first scan line; a second switching transistor comprising source and drain electrodes connected to second power and a second node, respetively, and a gate electrode connected to the first scan line; a third switching transistor comprising source and drain electrodes connected to the first node and the second node, respetively, and a gate electrode connected to a second scan line; a driving transistor comprising source and drain electrodes connected to the third node and the light emitting device, respetively, and a gate electrode connected to the second node; and a fourth switching transistor comprising source and drain electrodes connected to first power and the driving transistor, respetively, and selectively supplying the first power to the driving transistor.

In one embodiment, the present invention is a light emitting display comprising: a plurality of scan lines; a plurality of data lines; and a plurality of pixel circuits, wherein each pixel circuit comprising: a light emitting device; a driving transistor to receive a first voltage and supply a current corresponding to voltage applied to a gate electrode thereof to the light emitting device; a first switching device to supply a data signal in response to a first scan signal; a second switching device to supply a second voltage to the gate electrode of the driving transistor in response to the first scan signal; a capacitor to store voltage corresponding to the data signal and the second power according to operations of the first and second switching devices; a third switching device to apply voltage corresponding to the voltage stored in the capacitor to the gate electrode of the driving transistor in response to a second scan signal; and a fourth switching device to transmit the first voltage to the driving transistor in response to a third scan signal.

BRIEF DESCRIPTION OF THE DRAWINGS

These and/or other aspects and advantages of the invention will become apparent and more readily appreciated from the following description of some embodiments of the invention, taken in conjunction with the accompanying drawings of which.

DETAILED DESCRIPTION

Figure 1:
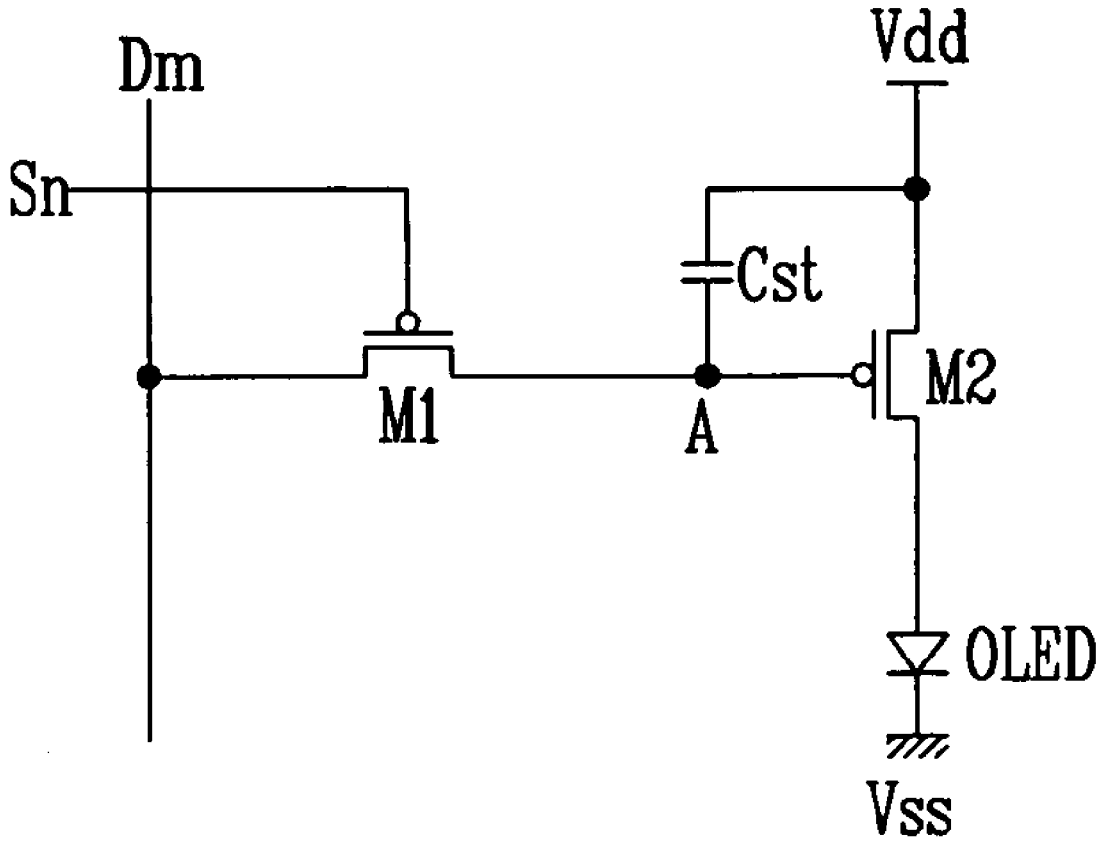
FIG. 1 (PRIOR ART)
FIG. 1 is a circuit diagram of a pixel provided in a conventional light emitting display.
Figure 2:
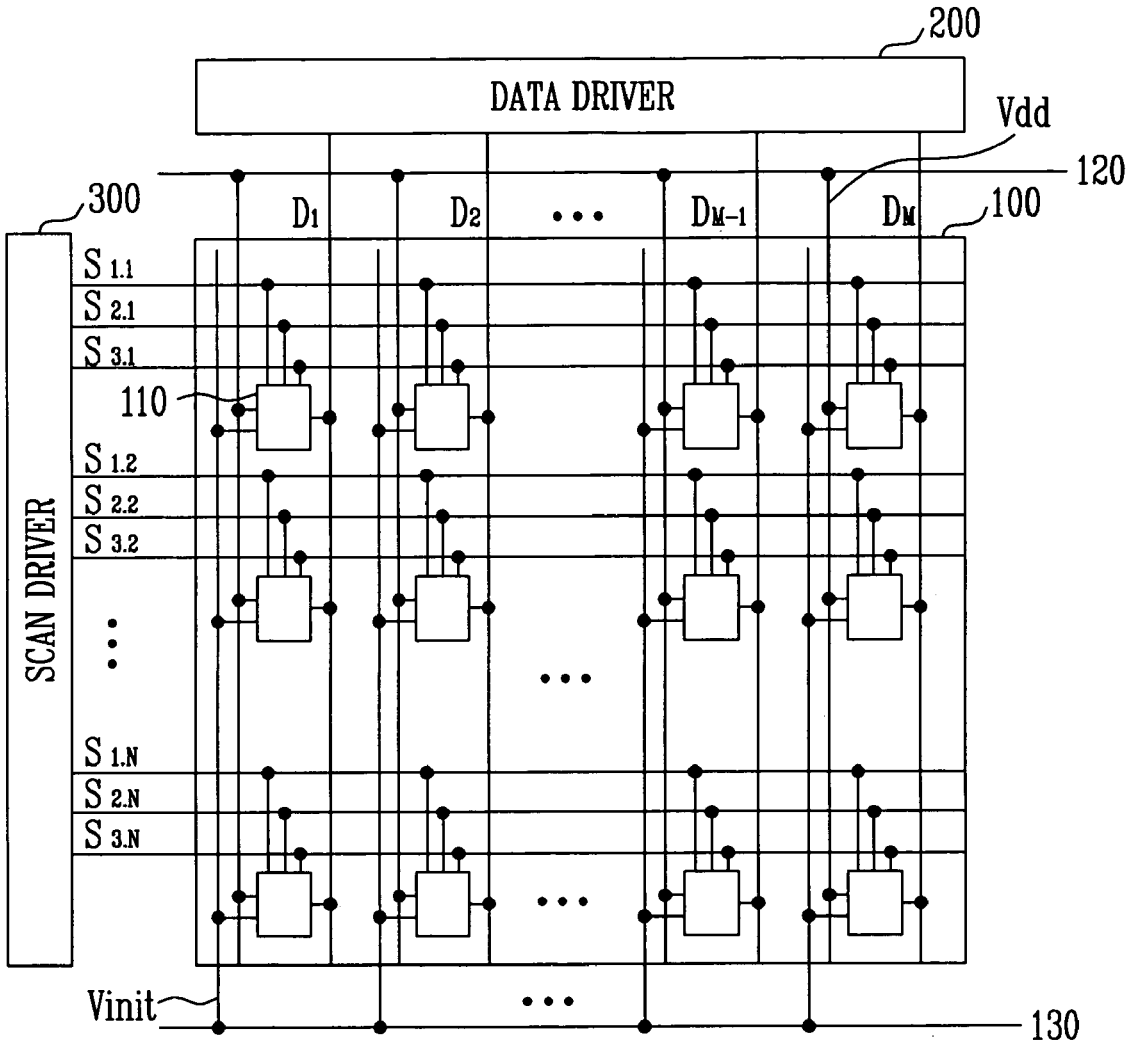
FIG. 2 illustrates configuration of a light emitting display according to an embodiment of the present invention.

FIG. 2 illustrates a configuration of a light emitting display according to an embodiment of the present invention. Referring to FIG. 2, the light emitting display comprises a pixel portion 100, a data driver 200, and a scan driver 300. The pixel portion 100 comprises a plurality of pixels 110 including N×M organic light emitting devices; N first scan lines S1.1, S1.2, . . . , S1.N−1, S1.N arranged in a row direction; N second scan lines S2.1, S2.2, . . . , S2.N−1, S2.N arranged in the row direction; N third scan lines S3.1, S3.2, . . . , S3.N−1, S3.N arranged in the row direction; M data lines D1, D2, . . . DM−1, DM arranged in a column direction; M pixel power lines Vdd to supply pixel power; and M compensation power lines Vinit to supply compensation power. Here, each pixel power line Vdd and each compensation power line Vinit are connected to a first power line 130 and a second power line 120.

Further, a data signal is transmitted from any of the data lines D1, D2, . . . DM−1, DM to a pixel 110 in response to a first scan signal and a second scan signal transmitted through any of the first scan lines S1.1, S1.2, . . . , S1.N−1, S1.N, and any of the second scan lines S2.1, S2.2, . . . , S2.N−1, S2.N to generate a driving current corresponding to the data signal. Also, the driving current is supplied to a corresponding organic light emitting device OLED in response to a third scan signal transmitted through one of the third scan lines S3.1, S3.2, . . . , S3.N−1, S3.N, thereby displaying an image.

The data driver 200 is connected to the data lines D1, D2, . . . DM−1, DM and supplies the data signal to the pixels 110. The scan driver 300 is provided on a side of the pixel portion 100, and connected to the first scan lines S1.1, S1.2, . . . , S1.N−1, S1.N, the second scan lines S2.1, S2.2, . . . , S2.N−1, S2.N, and the third scan lines S3.1, S3.2, . . . , S3.N−1, S3.N. The scan driver 300 supplies the first, second and third scan signals to the pixel portion 100, and selects the rows of the pixel portion 100 in sequence. Then, the data driver 200 supplies the data signal to the selected row, thereby allowing a pixel 110 to emit light based on the data signal.

Figure 3:
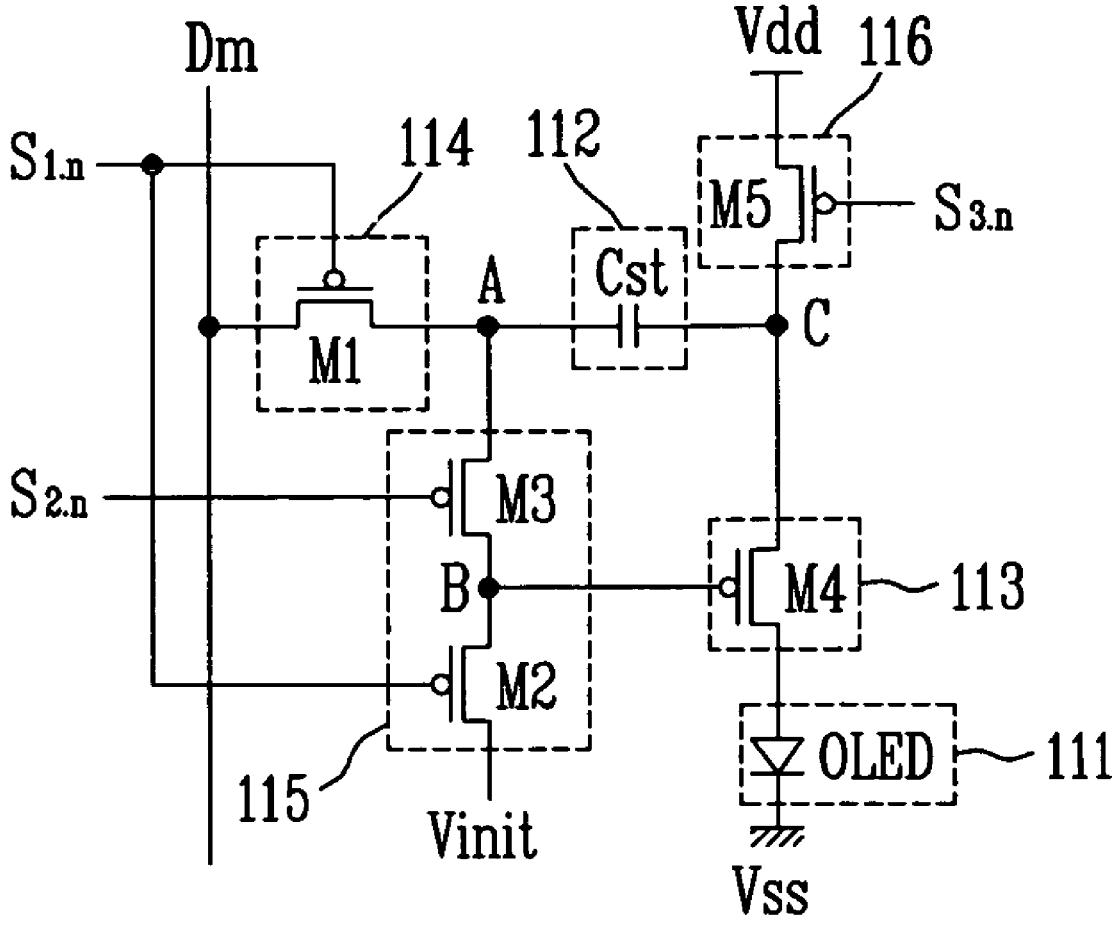
FIG. 3 is a circuit diagram of a pixel according to a first embodiment of the present invention.

FIG. 3 is a circuit diagram of a pixel according to a first embodiment of the present invention. As shown in FIG. 3, the pixel comprises an emission part 111, a storage part 112, a driving device 113, a first switching part 114, a second switching part 115, and a third switching part 116.

The driving device 113 comprises source, gate and drain electrodes, and determines the intensity of current inputted to the emission part 111 on the basis of voltage stored in the storage part 112, thereby controlling the brightness of the emission part 111.

The first switching part 114 receives the data signal and selectively transmits it to the storage part 112. The second switching part 115 selectively transmits either the voltage stored in the storage part 112 or the compensation voltage applied through the compensation power line Vinit to a gate electrode of the driving device 113, based on scan signals S1.n and S2.n.

The storage part 112 stores a predetermined voltage and supplies the stored voltage to the gate electrode of the driving device 113. Further, the storage part 112 stores voltage obtained by subtracting voltage applied to a source electrode of the driving device 113 from the voltage corresponding to the data signal received through the first switching part 114. Here, the voltage applied to the source electrode of the driving device 113 is higher than the compensation voltage by the absolute value of the threshold voltage of the driving device 113.

The third switching part 116 prevents the first power Vdd from being applied to the driving device 113 while the pixel power is selectively applied to the pixel through the pixel power line Vdd and stored in the storage part 112. Further, the third switching part 116 supplies the first power Vdd to the driving device 113 when the pixel power is completely stored in the storage part 112.

In other words, the pixel 110 comprises the organic light emitting device OLED and its peripheral circuits including a first switching transistor M1, a second switching transistor M2, a third switching transistor M3, a driving transistor M4, a fourth switching device M5, and a capacitor Cst. Each of the first through third switching transistors M1, M2, M3, the driving transistors M4, and the switching device M5 comprises a gate electrode, a source electrode, and a drain electrode. Further, the capacitor Cst comprises a first electrode and a second electrode.

The gate electrode of the first switching transistor M1 is connected to the first scan line S1.n, the source electrode is connected to the data line Dm, and the drain electrode is connected a first node A. Here, the first switching transistor M1 supplies the data signal to the first node A, in response to the first scan signal inputted through the first scan line S1.n.

The gate electrode of the second switching transistor M2 is connected to the first scan line S1.n, the source electrode is connected to the compensation power line Vinit, and the drain electrode is connected to a second node B. Here, the second switching transistor M2 supplies the compensation power from the compensation power line Vinit to the second node B, in response to the first scan signal inputted through the first scan line S1.n. Further, the compensation power inputted through the compensation power line Vinit is maintained as a high signal.

The capacitor Cst is connected between the first node A and a third node C, and charged with the voltage difference between the voltage applied to the first node A and the voltage applied to the third node C, thereby supplying the charged voltage to the gate electrode of the driving transistor M4 for a period corresponding to one frame.

The gate electrode of the third switching transistor M3 is connected to the second scan line S2.n, the source electrode is connected to the first node A, and the drain electrode is connected to the second node B. Here, the third switching transistor M3 supplies the voltage charged in the capacitor Cst to the gate electrode of the driving transistor M4 in response to the second scan signal inputted through the second scan signal S2.n.

The gate electrode of the driving transistor M4 is connected to the second node B, the source electrode is connected to the third node C, and the drain electrode is connected to the anode electrode of the organic light emitting device OLED. Here, the driving transistor M4 controls the current corresponding to the voltage applied to its own gate electrode to flow via its own source and drain electrodes, thereby supplying the current to the organic light emitting device OLED.

The gate electrode of the fourth switching device M5 is connected to the third scan line S3.n, the source electrode is connected to the pixel power line Vdd to supply the pixel power, and the drain electrode is connected to the third node C. Here, the fourth switching device M5 is switched in response to the third scan signal inputted through the third scan line S3.n, and thus selectively supplies the pixel power to the organic light emitting device OLED, thereby controlling the current flowing in the organic light emitting device OLED.

Figure 4:
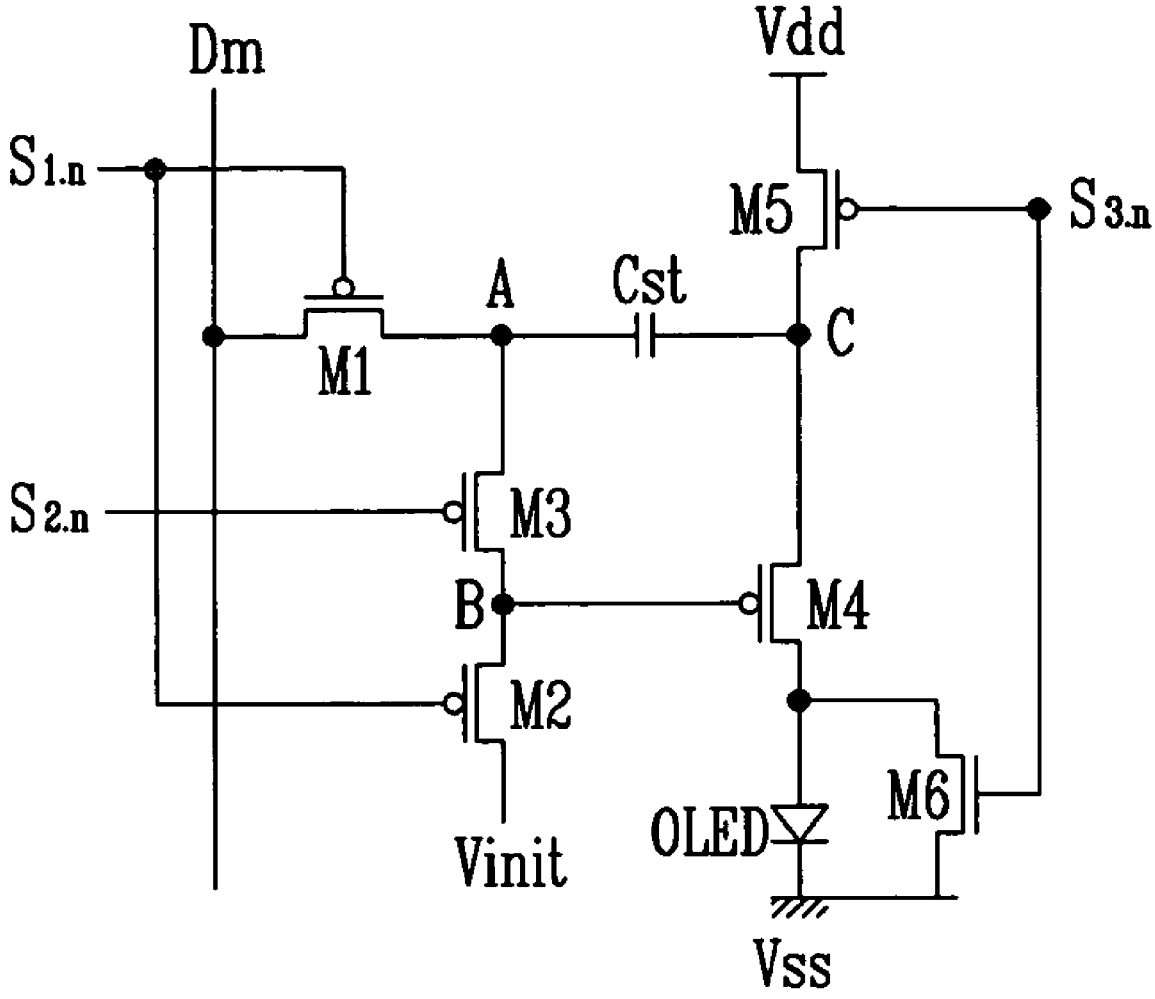
FIG. 4 is a circuit diagram of a pixel according to a second embodiment of the present invention.

FIG. 4 is a circuit diagram of a pixel according to a second embodiment of the present invention. Referring to FIG. 4, the pixel comprises an additional fifth switching transistor M6 connected in parallel to the organic light emitting device OLED, relative to the pixel circuit of the first embodiment.

The fifth switching transistor M6 comprises a gate electrode connected to a third scan line, a source electrode connected to a cathode electrode of the organic light emitting device OLED, and a drain electrode connected to an anode electrode of the organic light emitting device OLED. Further, the fifth switching transistor M6 has a reverse polarity relative to the fourth switching transistor M5. For example, when the fourth switching device M5 is of a p-type transistor as shown in FIG. 4, the fifth switching transistor M6 is of an n-type transistor. In this case, the fifth switching transistor M6 is turned off while the fourth switching device M5 is turned on. On the other hand, the fifth switching transistor M6 is turned on while the fourth switching device M5 is turned off.

Therefore, in a case that the organic light emitting device OLED emits light, the fifth switching transistor M6 is turned off, so that the current flows only in the organic light emitting device OLED. On the other hand, in a case that the organic light emitting device OLED does not emit light (particularly, while the threshold voltage is detected), the fifth switching transistor M6 is turned on, so that the current flows in the fifth switching transistor M6 and not in the organic light emitting device OLED, thereby preventing the organic light emitting device OLED from emitting light.

Figure 5:
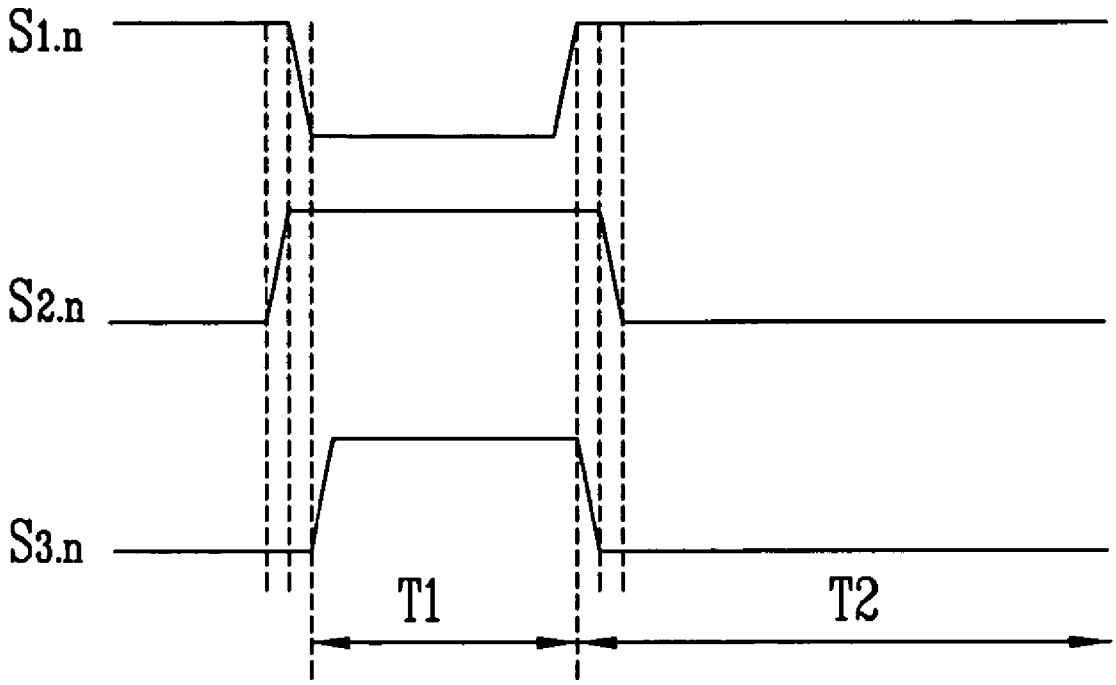
FIG. 5 shows timing between signals for driving the pixels shown in FIGS. 3 and 4.
Figure 6:
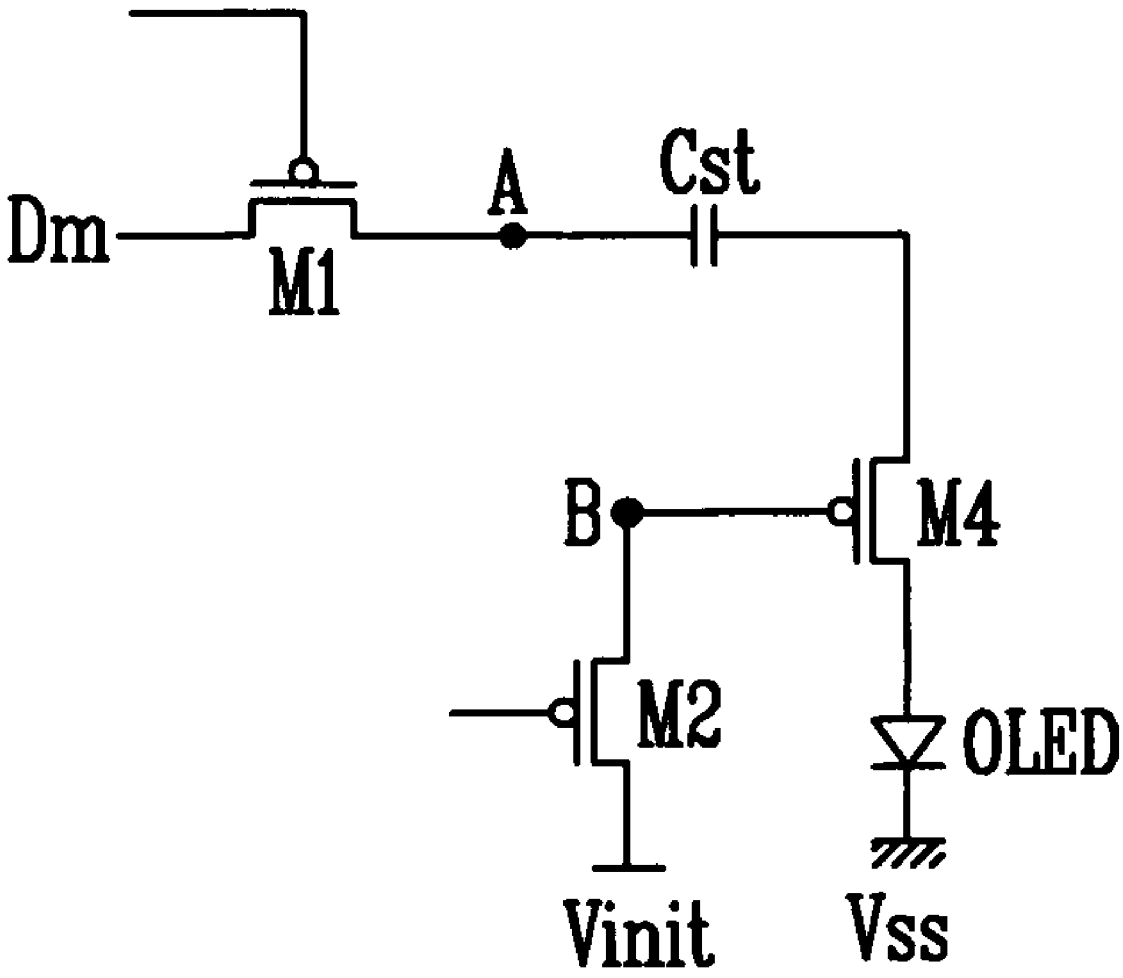
FIG. 6 is a circuit diagram for compensating for variations in the threshold voltage of the pixels shown in FIGS. 3 and 4.
Figure 7:
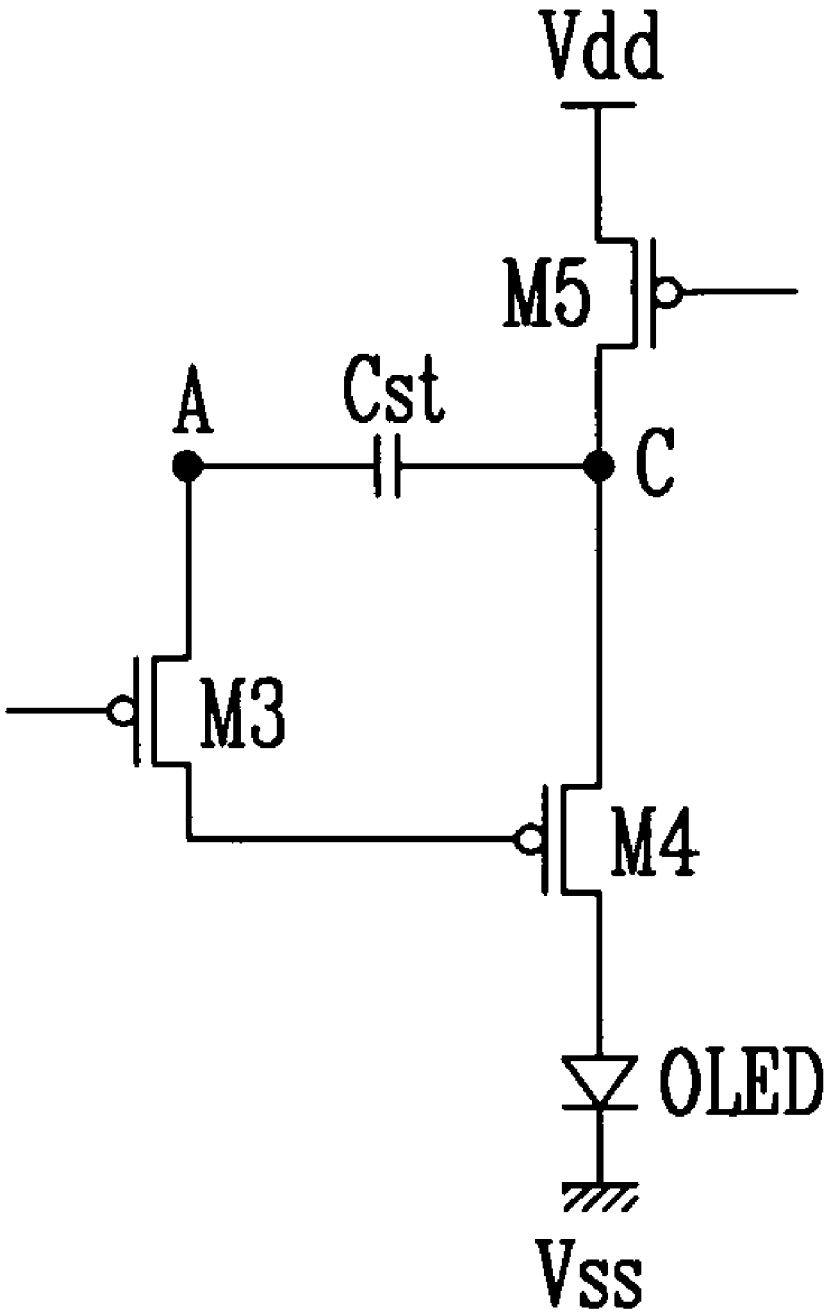
FIG. 7 is a circuit diagram formed when a driving voltage is applied to the pixels shown in FIGS. 3 and 4.

FIG. 5 shows timing of the signals for driving the pixels shown in FIGS. 3 and 4; FIG. 6 is a circuit diagram formed when threshold voltage is compensated in the pixels shown in FIGS. 3 and 4; and FIG. 7 is a circuit diagram formed when the driving voltage is applied to the pixels shown in FIGS. 3 and 4. Referring to FIGS. 5 through 7, operation of the pixel is divided according to a first operation period T1 and a second operation period T2. In the first operation period T1, the first scan signal s1.n is low, and the second scan signal s2.n and the third scan signal s3.n are high. In the second operation period T2, the first scan signal s1.n is high, and the second scan signal s2.n and the third scan signal s3.n are low.

In the first operation period T1, the first and second switching transistors M1 and M2 are turned on by the first scan signal s1.n, and the third and fourth switching transistors M3 and M4 are turned off by the second scan signal s2.n and the third scan signal s3.n. Hence, the circuit is connected as shown in FIG. 6.

Referring to FIG. 6, the data signal is transmitted to the first node A through the first switching transistor M1, and the compensation power is supplied to the gate electrode of the driving transistor M4 through the second switching transistor M2. At this time, the first scan signal s1.n is changed from a high state to a low state after the second scan signal s2.n is changed from a low state to a high state, so that the first and second switching transistors M1 and M2 are turned on after the third switching transistor M3 is turned off. Therefore, the data signal is not distorted by other voltage and is correctly stored in the capacitor, thereby applying a uniform voltage to the gate of the driving transistor M4.

Because the applied compensation power is a high signal, the driving transistor M4 is maintained in the off state, and thus the voltage applied to the source electrode of the driving transistor M4 is higher than the voltage applied to the gate electrode thereof by the threshold voltage. Therefore, the voltage based on the following equation 2 is applied between the source and gate electrodes of the driving transistor M4 by the capacitor Cst.

$$Vcst=Vdata-(Vinit-Vth); \quad \text{[Equation 2]}$$

where Vcst is a voltage charged in the capacitor; Vdata is a voltage corresponding to the data signal; Vinit is the compensation voltage and Vth is the threshold voltage of the driving transistor M4.

In order to correctly operate the driving transistor M4, the pixel power voltage should be larger than or equal to the sum of the compensation voltage and the absolute value of the threshold voltage of the driving transistor M4.

In the second operation period T2, the first scan signal s1.n is maintained in the high state, and the second scan signal s2.n and the third scan signal s3.n are maintained in the low state. The second operation period T2 is maintained for a period corresponding to one frame. During this time, the first and second switching transistors M1 and M2 are turned off by the first scan signal s1.n, and the third and fourth switching transistors M3 and M5 are turned on by the second scan signal s2.n and the third scan signal s3.n. Hence, the circuit is connected as shown in FIG. 7.

Referring to FIG. 7, the voltage charged in the capacitor Cst is applied to the gate electrode of the driving transistor M4, so that the current corresponding to the voltage charged in the capacitor Cst flows in the organic light emitting device OLED through the driving transistor M4. At this time, the second scan signal s2.n is changed from a high state to a low state after the first scan signal s1.n is changed from a low state to a high state, so that the third switching transistor M3 applies only the voltage charged in the capacitor Cst to the gate electrode of the driving transistor M4, thereby applying a uniform voltage to the gate electrode of the driving transistor M4.

Therefore, a current based on the following equation 3 flows from the driving transistor M4 to the organic light emitting device OLED.

$$I_{OLED} = \frac{\beta}{2}(Vgs - Vth)^2 = \frac{\beta}{2}(Vdata - Vinit)^2, \quad \text{[Equation 3]}$$

where $I_{OLED}$ is a current flowing in the organic light emitting device OLED; Vgs is a voltage applied between the source and gate electrodes of the driving transistor M4; Vdata is a voltage corresponding to the data signal; Vinit is a compensation voltage; and β is a gain factor of the driving transistor M4.

Therefore, as shown in the equation 3, the current flowing in the organic light emitting device OLED corresponds only to the data signal voltage and the compensation voltage, regardless of the threshold voltage of the driving transistor M4 and the pixel power.

At this time, the pixel power allows the current to flow in the light emitting device, so that a voltage drop occurs in the pixel power as the current flows. However, the compensation voltage is connected to the capacitor Cst, so that there is no current flowing to the pixel by the compensation power. Thus, a voltage drop does not occur in the compensation voltage.

Thus, in the pixels shown in FIGS. 3 and 4, the deviation between the threshold voltages of the driving transistors M4 is compensated, and the voltage drop in the pixel power is compensated, so that the pixels are suitable for realizing a large sized light emitting display.

Figure 8:
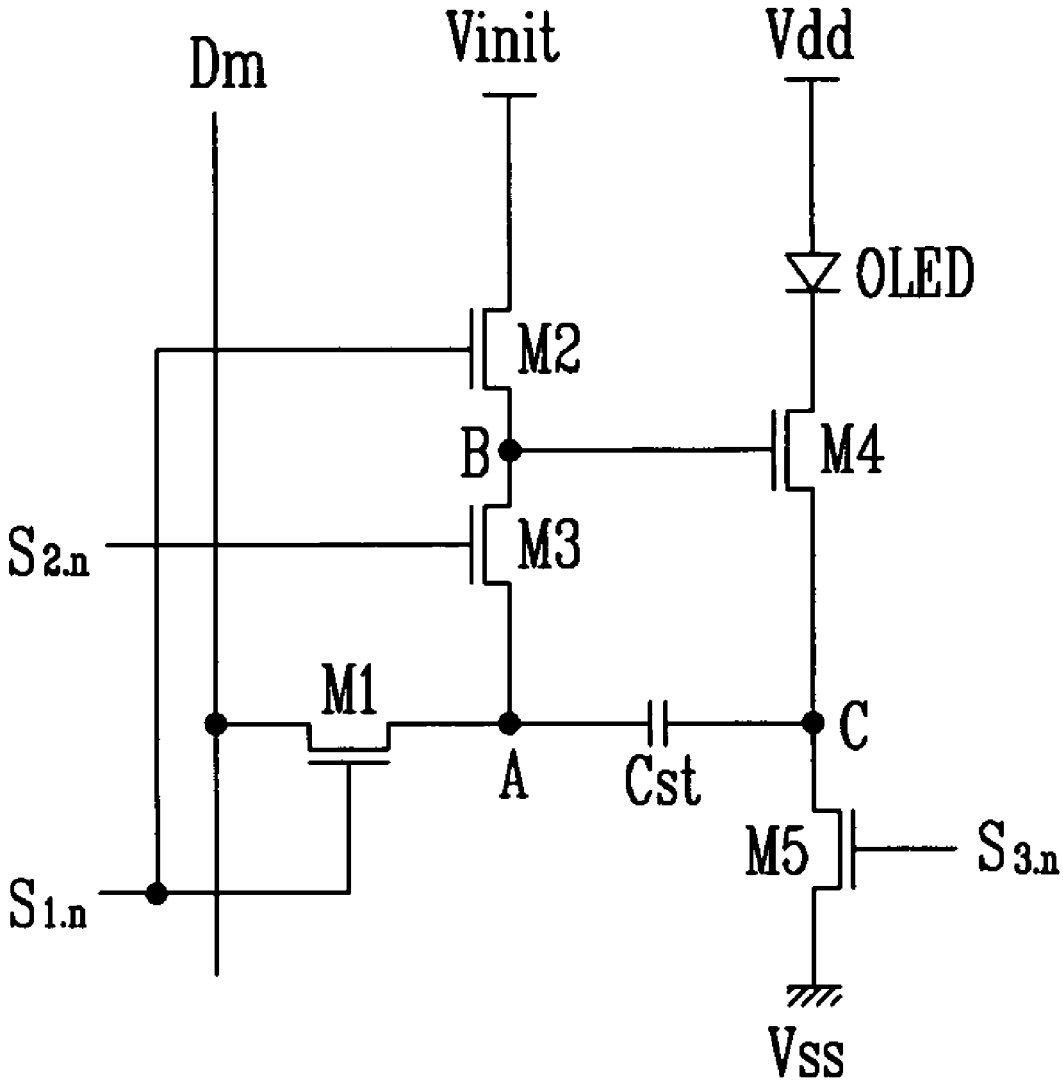
FIG. 8 is a circuit diagram of a pixel comprising NMOS transistors according to an embodiment of the present invention.

FIG. 8 is a circuit diagram of a pixel comprising NMOS transistors according to an embodiment of the present invention. Referring to FIG. 8, the pixel comprises an organic light emitting device OLED and its peripheral circuits including a first switching transistor M1, a second switching transistor M2, a third switching transistor M3, a driving transistor M4, a fourth switching device M5, and a capacitor Cst. Each of the first through third switching transistors M1, M2, M3, the driving transistors M4, and the switching device M5 is realized by an NMOS transistor comprising a gate electrode, a source electrode, and a drain electrode. Further, the capacitor Cst comprises a first electrode and a second electrode.

The organic light emitting device OLED is connected to the driving transistor M4, and the fourth switching device M5 is connected between the driving transistor M4 and a cathode electrode.

Figure 9:
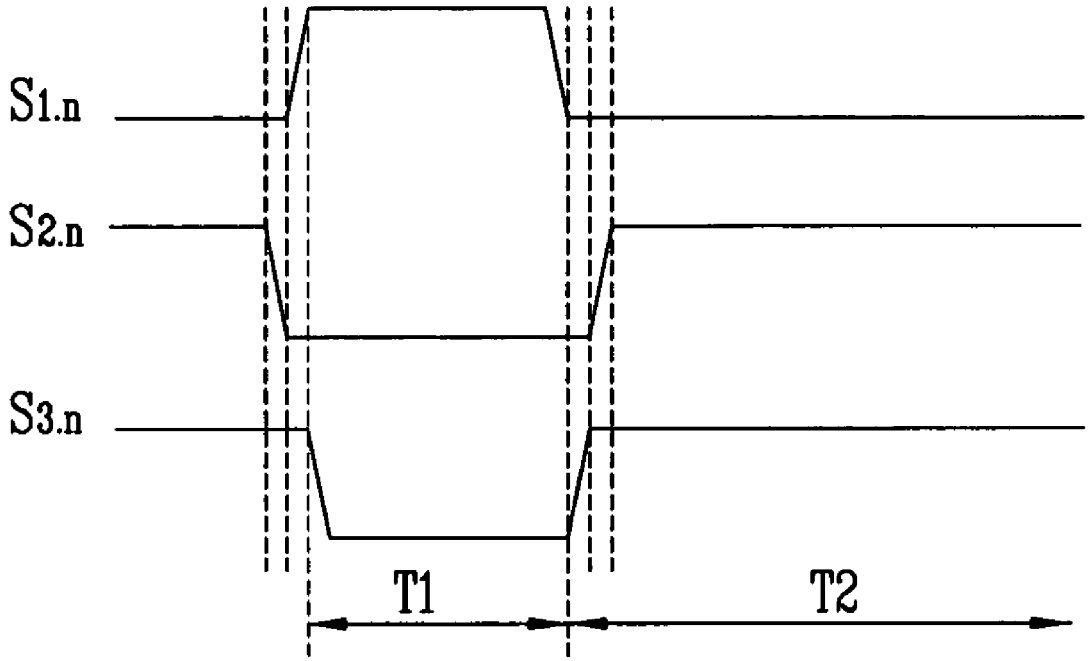
FIG. 9 shows timing of signals for driving the pixel shown in FIG. 8.

FIG. 9 shows timing between signals for driving the pixel shown in FIG. 8. Referring to FIG. 9, operation of the pixel is divided according to a first operation period T1 and a second operation period T2. In the first operation period T1, the first scan signal s1.n is high, and the second scan signal s2.n and the third scan signal s3.n are low. In the second operation period T2, the first scan signal s1.n is low, and the second scan signal s2.n and the third scan signal s3.n are high.

In the first operation period T1, the first and second switching transistors M1 and M2 are turned on by the first scan signal s1.n, and the third and fourth switching transistors M3 and M5 are turned off by the second scan signal s2.n and the third scan signal s3.n. Hence, the compensation voltage is supplied from the compensation power line Vinit to the gate electrode of the driving transistor M3, and the capacitor Cst is charged with a voltage based on the equation 2. During this time, the compensation power supplied through the compensation power line Vinit is kept low.

In the second operation period T2, the first scan signal s1.n is kept low, and the second scan signal s2.n and the third scan signal s3.n are kept high. The second operation period T2 is maintained for a period corresponding to one frame. During this time, the first and second switching transistors M1 and M2 are kept turned off by the first scan signal s1.n, and the third and fourth switching transistors M3 and M5 are kept turned on by the second scan signal s2.n and the third scan signal s3.n. The voltage stored in the capacitor Cst is applied to the organic light emitting device OLED, so that the driving current based on the equation 3 flows therein.

In the foregoing embodiment, the fourth switching device M5 for controlling the current to flow in the organic light emitting device OLED may be an NMOS transistor when other transistors provided in the pixel are PMOS transistors. Alternately, the fourth switching device M5 may be a PMOS transistor when other transistors provided in the pixel are NMOS transistors.

As described above, the present invention provides a pixel circuit and a light emitting display, in which current flows in a driving transistor regardless of threshold voltage of the driving transistor and pixel power. Thus, the difference between the threshold voltages is compensated, so that the intensity of current flowing in the light emitting device does not vary due to voltage drop in first power used for the pixel power and a decrease in the pixel power voltage, thereby improving the uniformity of brightness of the light emitting device.

Although a few embodiments of the present invention have been shown and described, it would be appreciated by those skilled in the art that changes might be made in this embodiment without departing from the principles and spirit of the invention, the scope of which is defined in the claims and their equivalents.

What is claimed is:

1. A pixel circuit comprising:

a light emitting device;

a driving transistor to receive a first voltage and supply a current to the light emitting device, corresponding to voltage applied to a gate electrode thereof;

a first switching device to supply a data signal in response to a first scan signal;

a second switching device to supply a second voltage to the gate electrode of the driving transistor in response to the first scan signal;

a capacitor to store a voltage corresponding to the data signal and the second voltage according to operations of the first and second switching devices;

a third switching device to apply voltage corresponding to the voltage stored in the capacitor to the gate electrode of the driving transistor in response to a second scan signal; and a fourth switching device to transmit the first voltage to the driving transistor in response to a third scan signal.

2. The pixel circuit according to claim 1, further comprising a fifth switching device to interrupt the current from flowing in the light emitting device in response to the third scan signal.

3. The pixel circuit according to claim 1, wherein the voltage stored in the capacitor is equal to voltage obtained by subtracting a sum of the second voltage and a threshold voltage of the driving transistor from the voltage corresponding to the data signal.

4. The pixel circuit according to claim 2, wherein the voltage stored in the capacitor is equal to voltage obtained by subtracting a sum of the second voltage and a threshold voltage of the driving transistor from the voltage corresponding to the data signal.

5. The pixel circuit according to claim 1, wherein the first, second and third scan signals are of a periodic signal, and each period of the first, second, and third scan signals comprises a first period and a second period, and wherein the first scan signal is in on and off states for the first and second periods, respectively;

the second scan signal is in off and on states for the first and second periods, respectively; and the third scan signal is in off and on states for the first and second periods, respectively.

6. The pixel circuit according to claim 2, wherein the first, second, and third scan signals are of a periodic signal, and each period of the first, second, and third scan signals comprises a first period and a second period, and wherein the first scan signal is in on and off states for the first and second periods, respectively;

the second scan signal is in off and on states for the first and second periods, respectively; and the third scan signal is in off and on states for the first and second periods, respectively.

7. The pixel circuit according to claim 1, wherein the second voltage maintains the driving transistor in an off state.

8. The pixel circuit according to claim 2, wherein the second voltage maintains the driving transistor in an off state.

9. The pixel circuit according to claim 1, wherein an absolute value of the difference between the first voltage and the second voltage is larger than or equal to an absolute value of a threshold voltage of the driving transistor.

10. The pixel circuit according to claim 2, wherein an absolute value of difference between the first power and the second power is larger than or equal to an absolute value of a threshold voltage of the driving transistor.

11. The pixel circuit according to claim 2, wherein the fourth switching device and the fifth switching device are driven by the third scan signal to be in different states.

12. A pixel circuit comprising:

a light emitting device;

a driving transistor to supply a driving current corresponding to a voltage applied to a gate electrode thereof to the light emitting device;

a capacitor to store a predetermined voltage corresponding to a data signal and a second voltage applied to the gate electrode of the driving transistor;

a first switch to selectively supply the data signal to the capacitor;

a second switch to supply one of the voltage stored in the capacitor and the second voltage to the gate electrode of the driving transistor; and a third switch to selectively supply a first voltage to the driving transistor.

13. The pixel circuit according to claim 12, wherein the voltage stored in the capacitor is equal to a voltage obtained by subtracting a sum of the second voltage and a threshold voltage of the driving transistor from the voltage corresponding to the data signal.

14. The pixel circuit according to claim 12, wherein the first, second, and third switches receive first, second, and third scan signals, respectively, and wherein the first, second, and third scan signals are periodic signals, and each period of the first, second, and third scan signals comprises a first period and a second period, the first scan signal is in an on state for the first and in an off state for the second period;

the second scan signal is in the off state for the first and in the on state for the second period; and the third scan signal is in the off state for the first and in the on state for the second period.

15. The pixel circuit according to claim 14, wherein the first switch receives the first scan signal, the second switch selectively receives the first and second scan signals, and the third switch receives the third scan signal.

16. The pixel circuit according to claim 12, wherein an absolute value of the difference between the first voltage and the second voltage is larger than or equal to an absolute value of a threshold voltage of the driving transistor.

17. A pixel circuit comprising:

a light emitting device;

a capacitor comprising a first terminal connected to a first node, and a second terminal connected to a third node;

a first switching transistor comprising a source electrode connected to a data line, a drain electrode connected to the first node, and a gate electrode connected to a first scan line;

a second switching transistor comprising a source electrode connected to a second power supply, a drain electrode connected to the second node, and a gate electrode connected to the first scan line;

a third switching transistor comprising a source electrode connected to the first node, a drain electrode connected to the second node, and a gate electrode connected to a second scan line;

a driving transistor comprising a source electrode connected to a third node, a drain electrode connected to the light emitting device, and a gate electrode connected to the second node; and a fourth switching transistor comprising a source electrode connected to a first power supply, a drain electrode connected to the driving transistor, the fourth transistor selectively supplying the first power supply to the driving transistor.

18. The pixel circuit according to claim 17, further comprising a fifth switching device connected to the light emitting device and maintained to have an opposite on/off state to state of the fourth switching transistor.

19. The pixel circuit according to claim 17, wherein the second power supply maintains the driving transistor to be in an off state.

20. The pixel circuit according to claim 17, wherein an absolute value of the difference between the first power supply and the second power supply is larger than or equal to an absolute value of a threshold voltage of the driving transistor.

21. A light emitting display comprising:

a plurality of scan lines;

a plurality of data lines; and a plurality of pixel circuits, wherein each pixel circuit comprising:

a light emitting device;

a driving transistor to receive a first voltage and supply a current to the light emitting device corresponding to voltage applied to a gate electrode thereof;

a first switching device to supply a data signal in response to a first scan signal;

a second switching device to supply a second voltage to the gate electrode of the driving transistor in response to the first scan signal;

a capacitor to store a voltage corresponding to the data signal and the second voltage according to operations of the first and second switching devices;

a third switching device to apply voltage corresponding to the voltage stored in the capacitor to the gate electrode of the driving transistor in response to a second scan signal; and a fourth switching device to transmit the first voltage to the driving transistor in response to a third scan signal.

22. The light emitting display according to claim 21, wherein the voltage stored in the capacitor is equal to voltage obtained by subtracting a sum of the second voltage and a threshold voltage of the driving transistor from the voltage corresponding to the data signal.

23. The light emitting display according to claim 21, wherein the voltage stored in the capacitor is equal to voltage obtained by subtracting a sum of the second voltage and a threshold voltage of the driving transistor from the voltage corresponding to the data signal.

24. The light emitting display according to claim 21, wherein the first, second, and third scan signals are of a periodic signal, and each period of the first, second, and third scan signals comprises a first period and a second period, and wherein the first scan signal is in on and off states for the first and second periods, respectively;

the second scan signal is in off and on states for the first and second periods, respectively; and the third scan signal is in off and on states for the first and second periods, respectively.

25. The light emitting display according to claim 21, wherein the second voltage maintains the driving transistor in an off state.

26. The light emitting display according to claim 21, wherein the fourth switching device and the fifth switching device are driven by the third scan signal to be in different states.

27. The light emitting display according to claim 21, further comprising a fifth switching device to prevent the supplied current from flowing in the light emitting device in response to the third scan signal.

28. The light emitting display according to claim 21, further comprising:

a scan driver to supply the first, second, and third scan signals; and a data driver to supply the data signal.

* * * * *